US006378275B1

(12) United States Patent
Andersson

(10) Patent No.: US 6,378,275 B1
(45) Date of Patent: Apr. 30, 2002

(54) MULTI-PRODUCT PACKING MACHINE WITH BAR CODE READER

(75) Inventor: Sven-Arne Andersson, Buffalo Grove, IL (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/465,582

(22) Filed: Dec. 17, 1999

Related U.S. Application Data

(62) Division of application No. 09/063,763, filed on Apr. 21, 1998, now Pat. No. 6,119,434.

(51) Int. Cl.[7] ..... B65B 3/02; B65B 1/30
(52) U.S. Cl. ..... 53/458; 53/493
(58) Field of Search ..... 53/237, 493, 458, 53/452; 141/9, 100

(56) References Cited

U.S. PATENT DOCUMENTS 5,448,499 A * 9/1995 Palmer ..... 364/500
5,687,779 A * 11/1997 Andersson et al. ..... 141/105
6,119,434 A * 9/2000 Andersson ..... 53/237

* cited by examiner

*Primary Examiner*—John Paradiso
(74) *Attorney, Agent, or Firm*—Welsh & Katz, Ltd.

(57) ABSTRACT

A packaging system having a bar code reader integrated therein for conveying information concerning the size and filling requirements of a product to a packaging machine which will produce the product. The packaging machine is capable of consecutively filling cartons with different products in a single production cycle. The bar code reader provides this information from the bar code placed on every blank that is to be produced into a formed, filled and sealed carton. The filling system of the packaging machine may have a primary and secondary product for mixing in a package to produce a final product. Alternatively, the filling system may have several filling pipes, each filling pipe dispensing a different product. The bar code reader instructs the conveyor under which fill pipe a particular carton should be filled to match the product with the carton.

5 Claims, 9 Drawing Sheets

MULTI-PRODUCT PACKING MACHINE WITH BAR CODE READER

CROSS REFERENCES TO RELATED APPLICATIONS

This is a divisional of application Ser. No. 09/063,763 filed Apr. 21, 1998, now U.S. Pat. No. 6,119,434 issued Apr. 19, 2000.

STATEMENT REGARDING FEDERALLY SPONSORED RESEARCH OR DEVELOPMENT

Not Applicable

BACKGROUND OF THE INVENTION

1. Field of the Invention

The present invention relates to linear form, fill and seal packaging machines. Specifically, the present invention relates to packaging machine capable of processing a multitude of different products and having a bar code reader to properly process each of the products in the correct carton.

2. Description of the Related Art

Packages formed from a blank are usually processed on a linear form, fill and seal packaging machine. Each blank is delivered to a mandrel of the packaging machine from a carton blank opener. The blank opener is fed with a series of blanks from a magazine. The magazine holds a stack of flat blanks that are erected on the carton blank opener prior to placement on the mandrel.

Once on the mandrel, each carton has its bottom formed prior to placement on a conveyor. On the conveyor, each carton may be fitted with a fitment and sterilized prior to filling and top sealing. Novel filling techniques as disclosed in U.S. Pat. No. 5,687,779 have emerged to fulfill a need in the packaging industry, that need being the ability of a packaging machine to consecutively fill cartons with different products. This breakthrough in the packaging industry has created additional problems that must be met before the full potential of the novel filling systems is realized by dairies and other producers of flowable food products such as milk, juice, yogurt and the like.

One of the most pressing needs is to instruct the packaging machine of the product to be filled in a carton. The packaging machine must be able to automatically know which product to fill the carton with in order to fully utilize the system. Manual instructions would under utilize the potential of the novel filling system.

BRIEF SUMMARY OF THE INVENTION

Andersson et al, U.S. Pat. No. 5,67,779 ("'779 patent") for a Packaging Machine System For Filling Primary And Secondary Products Into A Container, having a common assignee with the present application and which is hereby incorporated by reference in its entirety, discloses a system for filling two products simultaneously into a package. A portion of the '779 patent discloses programming the packaging machine, via a user interface at a control panel, to produce a product with a desired milkfat content. The operator also selects the number of cartons to be filled and the volume of each carton. The operator may select several different products that vary in quantity. Once the packaging machine is programmed, a production cycle may be commenced to produce the desired products.

The present invention builds upon the '779 patent, and provides for the elimination of the need to program the packaging machine for filling purposes prior to each production cycle. The present invention allows for the novel filling system to achieve its full potential in the processing of different products during a single production cycle. The present invention is able to accomplish this achievement by providing a bar code reader that is integrated on the packaging system to obtain from each individual carton the filling and size requirements of the carton thereby eliminating the need of an operator to program the packaging machine for each production cycle.

The packaging machine may be a single processing line or dual processing line machine. The bar code is utilized in connection with a programmable logic controller ("PLC") to control the filling and other necessary operations of a packaging machine. The bar code reader may be placed on a magazine, a carton opener or along the machine conveyance line or lines.

The present invention allows for a single packaging machine to process different products during a single production cycle. For example, skim milk, whole milk and two percent milk may be produced during a single production cycle without suspending the operation. Also, the same product for different retail distributors may be produced in a single production cycle. Further, it is contemplated that various products ranging from juice, to milk to yogurt may be filled in cartons on a single packaging machine during a single production cycle.

It is a primary object of the present invention to provide a packaging system for filling various products consecutively on a packaging machine, each of the different products having its own distinguishing carton.

It is an additional object of the present invention to provide a packaging machine with a bar code reader for controlling the filling operation of the packaging machine.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a packaging system of the present invention;

Figure 1:
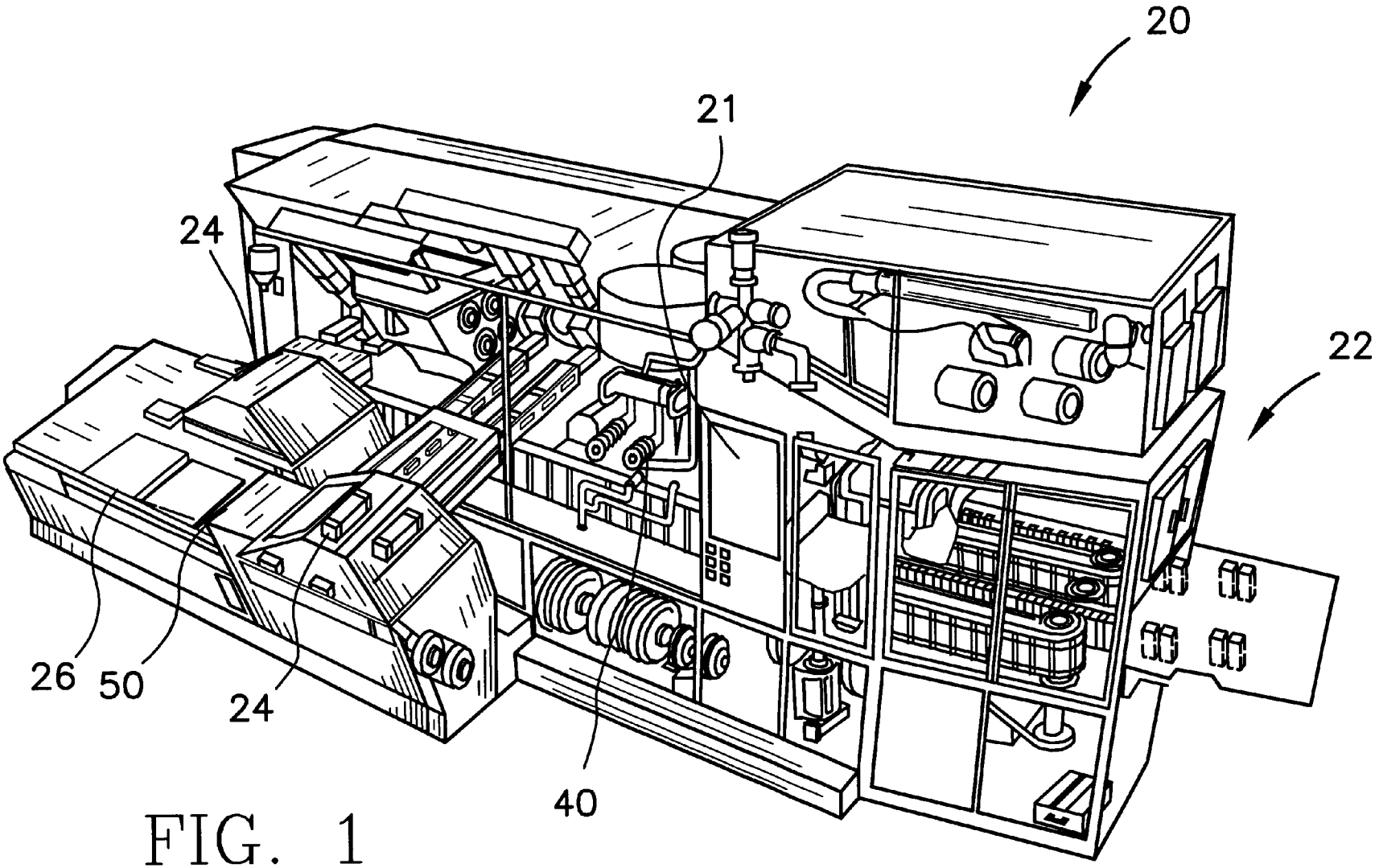
Figure 1A:
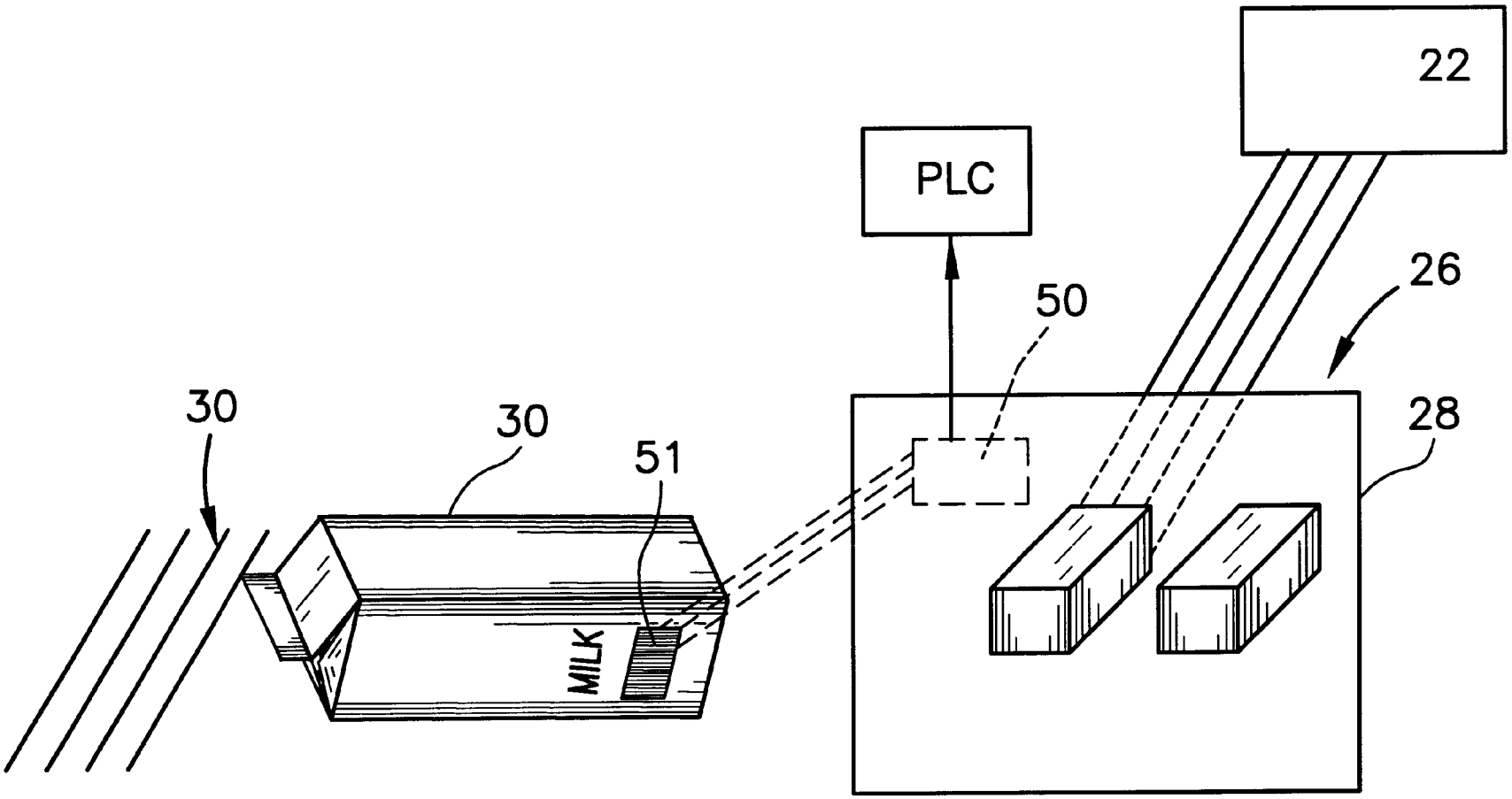
Figure 2:
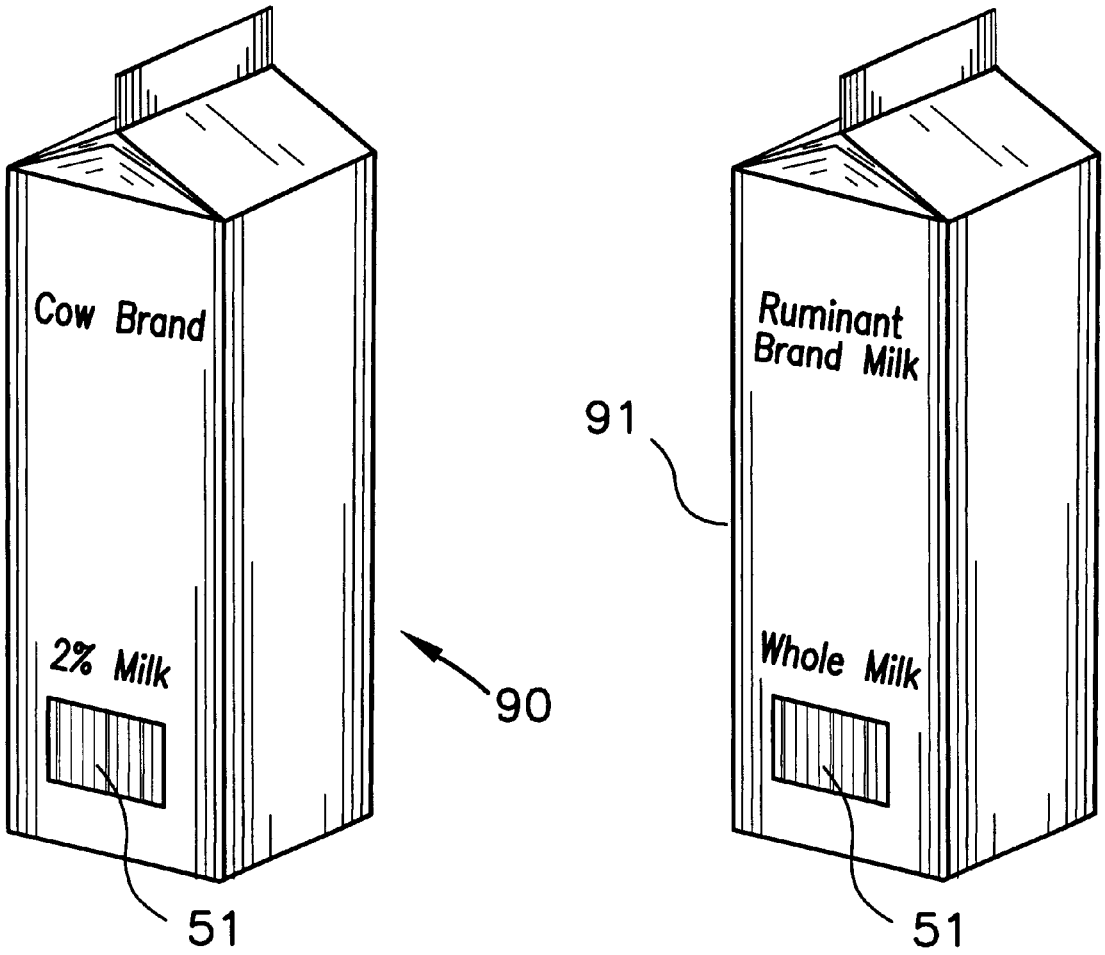
Figure 3:
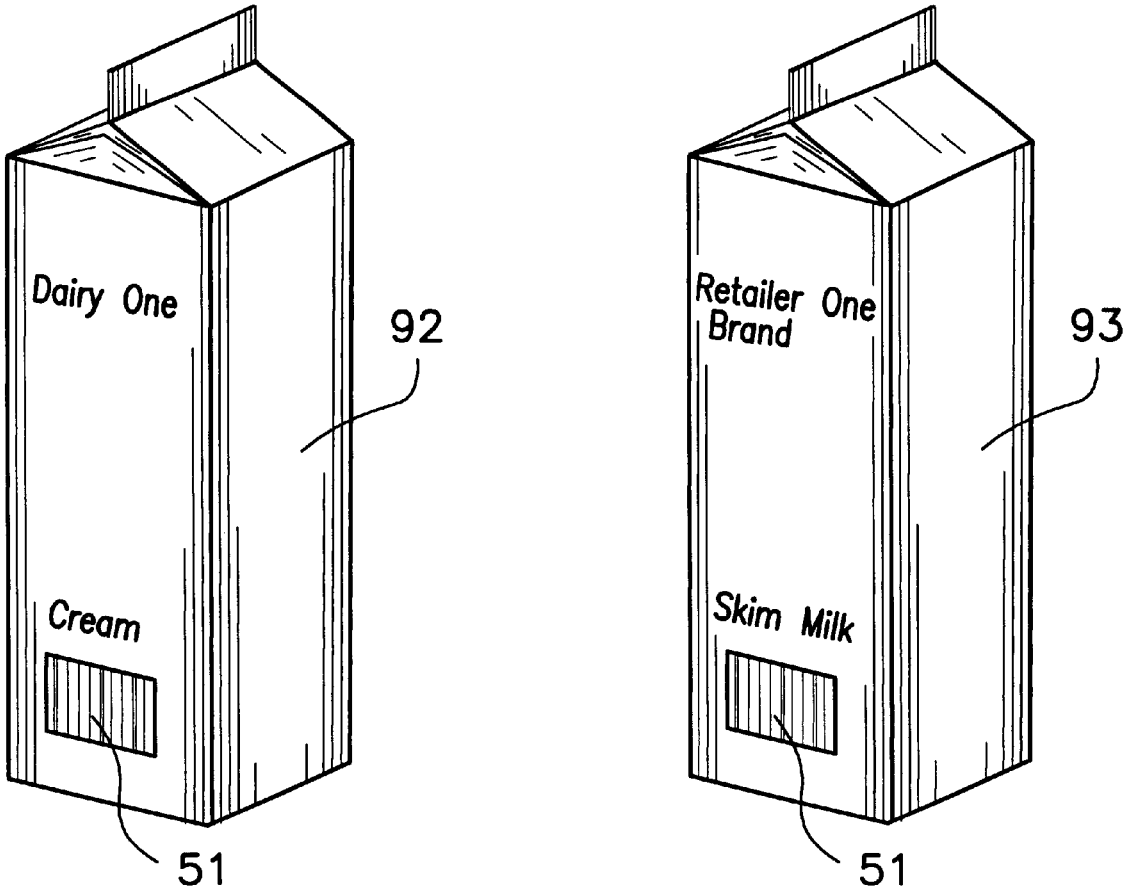
Figure 4:
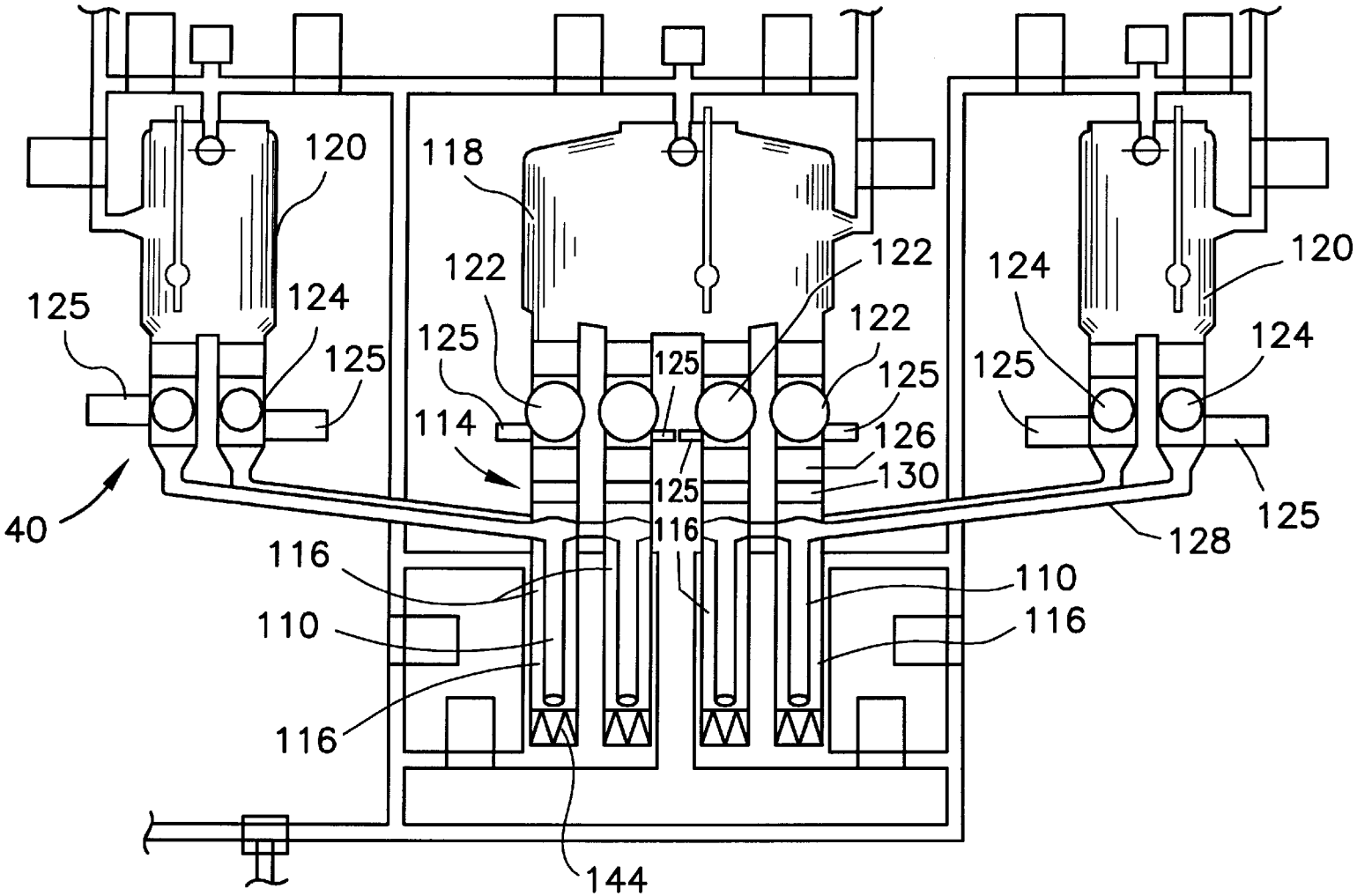
Figure 5:
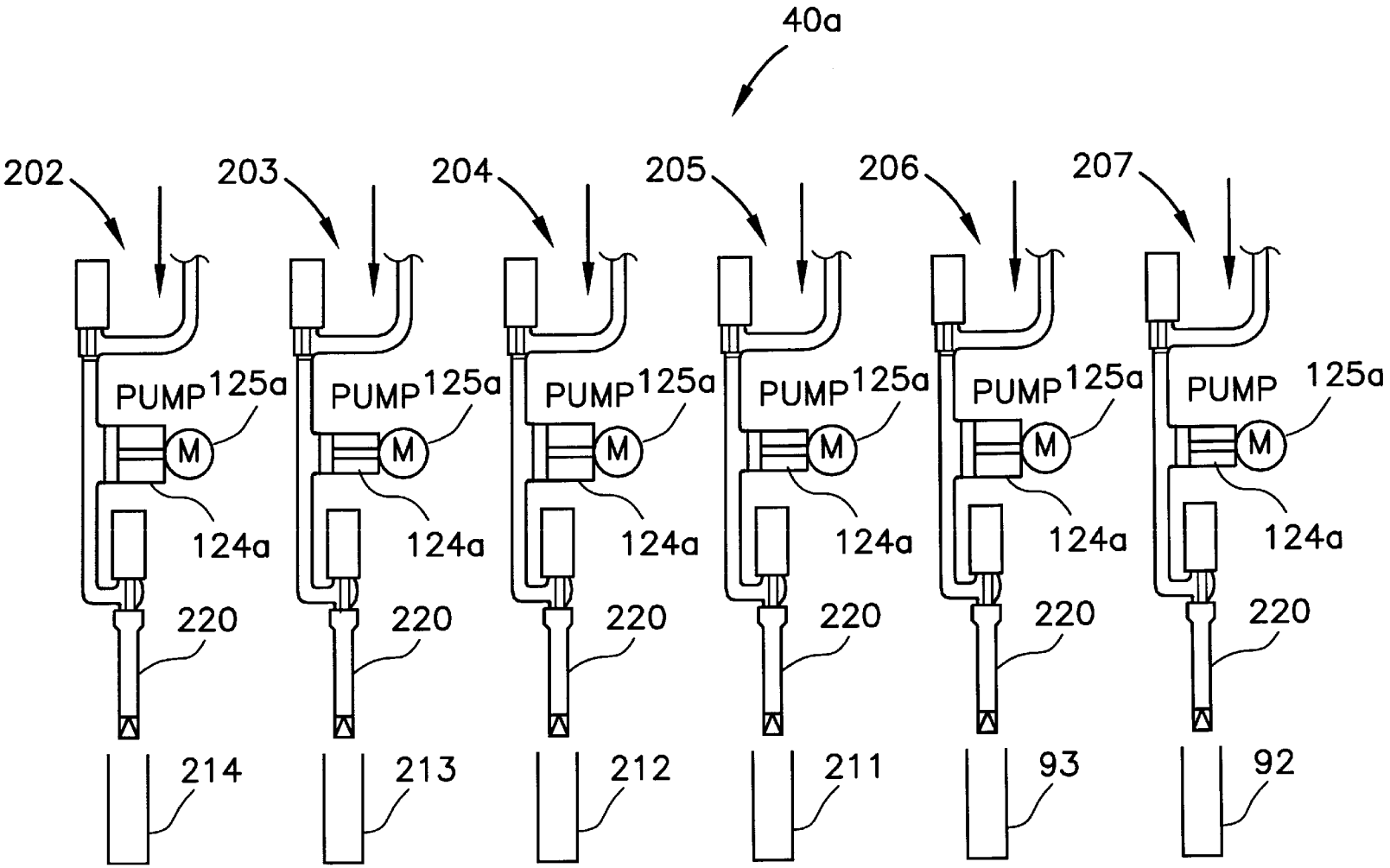
Figure 6:
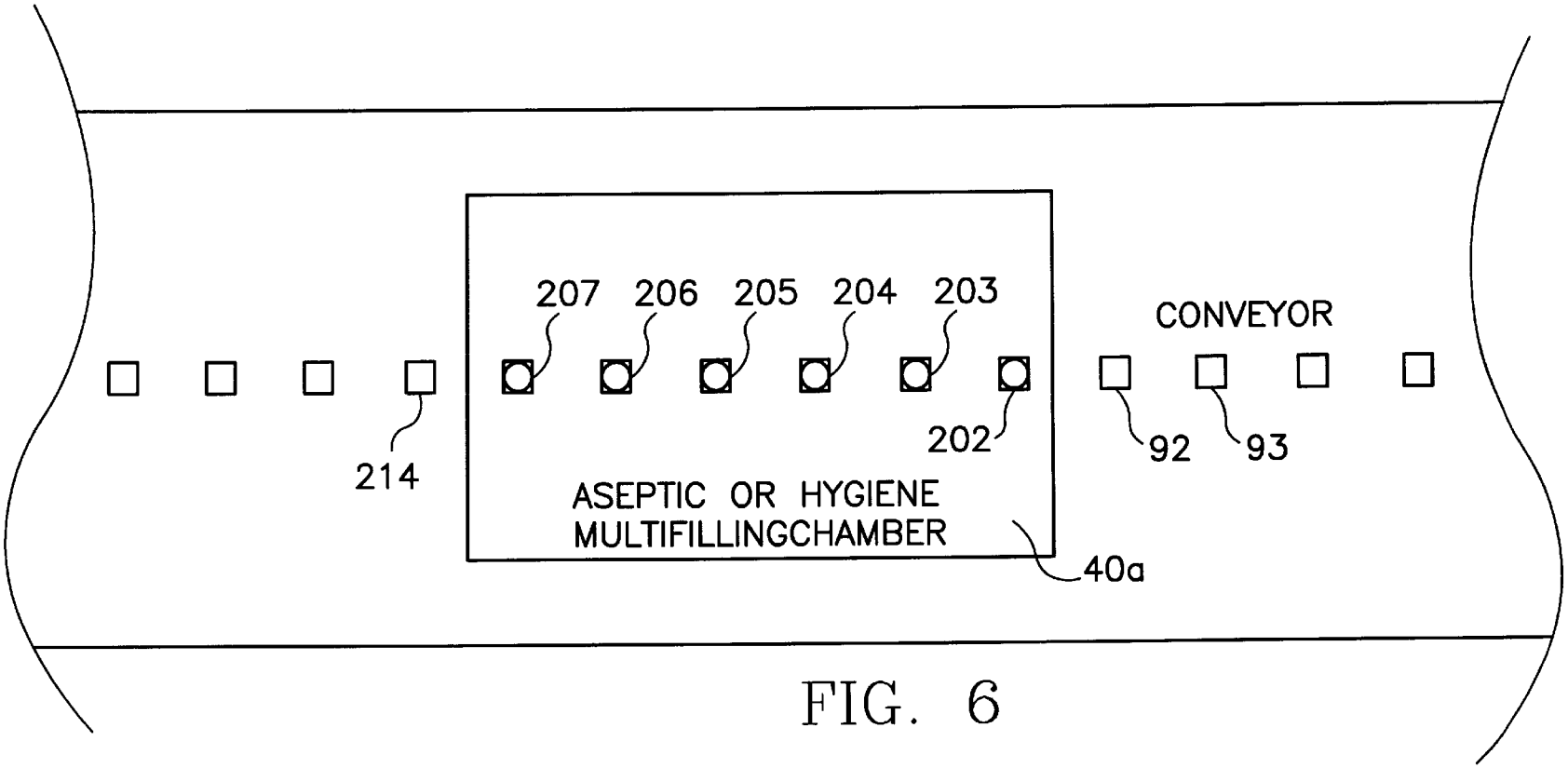
Figure 7:
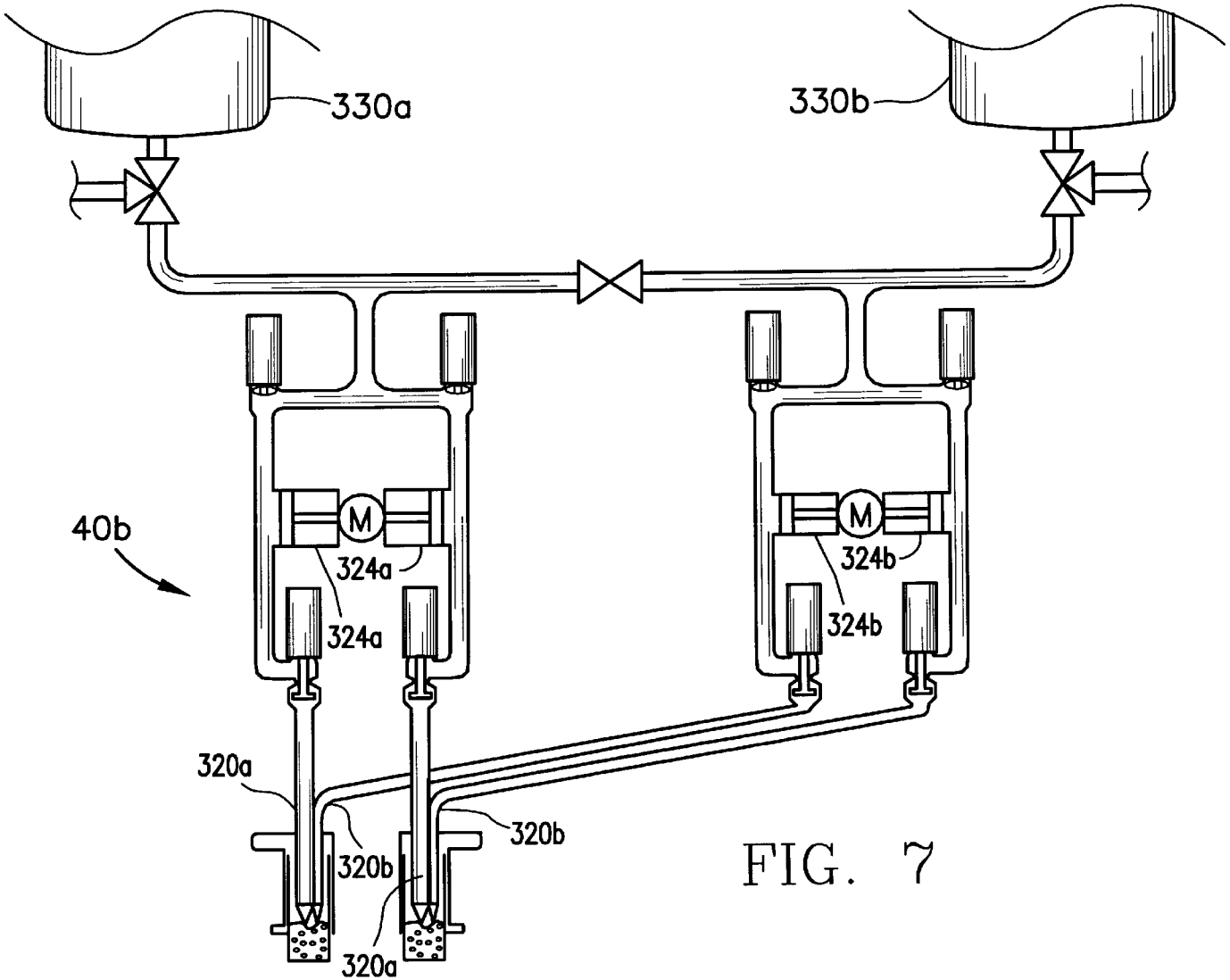
Figure 8:
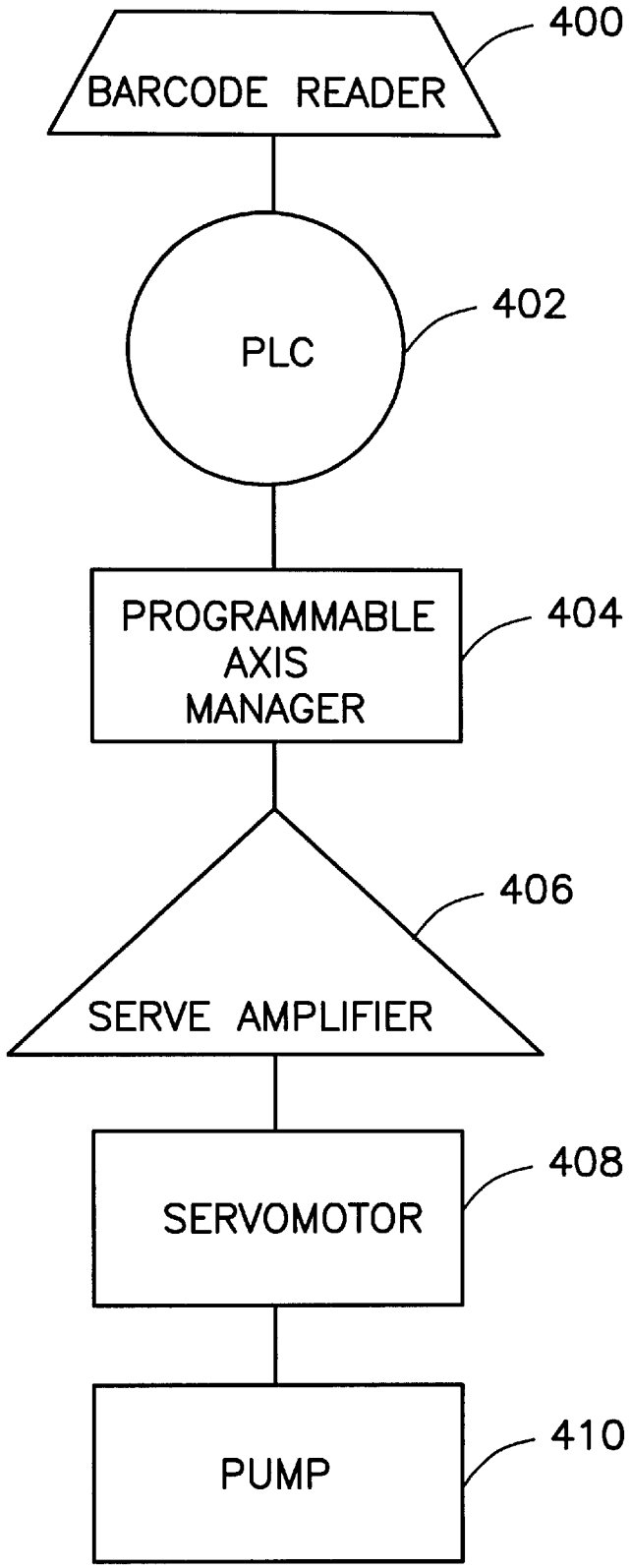

There is illustrated in FIG. 1A a preferred placement of the bar code reader on the packaging system;

There is illustrated in FIGS. 2 and 3 top perspective views of cartons of different sizes and products;

There is illustrated in FIG. 4 a schematic view of a dual stream filling system;

There is illustrated in FIG. 5 a schematic side view of an alternative filling system;

There is illustrated in FIG. 6 a schematic top plan view of the filling system of FIG. 5;

There is illustrated in FIG. 7 a schematic view of yet another embodiment of a filling system;

There is illustrated in FIG. 8 a flow diagram of the information and instructions from a bar code reader to the filling system.

DETAILED DESCRIPTION OF THE INVENTION

There is illustrated in FIG. 1 a packaging system generally designated 20. The packaging system 20 includes a packaging machine 22, a carton opener 22, a magazine 26, and optionally an automatic carton loader ("ACL") 28. The packaging machine may be a typical linear form, fill and seal packaging machine such as a TETRA REX® packaging machine available from Tetra Pak, Incorporated of Chicago, Ill. The packaging machine 22 may have a programmable logic controller ("PLC") 21 to control the various operations of the packaging system 20. Also, disposed within the packaging system 20 is a bar code reader 50 which communicates the size and filling requirements to the necessary components of the packaging machine 22, such as the filling station 40, via the PLC 21.

A plurality of different blanks 30 are transported from the ACL 28 to magazine 26. The blanks 30 are then transferred individually to the carton opener 24 for erection of the blank for placement on a mandrel of the packaging machine 22. After bottom forming on the mandrel, each carton is transported along the conveyor for eventual filling with a product at a filling station 40 that is described below.

FIGS. 2 and 3 illustrate various cartons that may be consecutively produced on a packaging system 20 of the present invention. Each carton 90–93, has a bar code 51 thereon which conveys the product and volume of the carton. The bar code 51 may also have the final destination information contained therein. The final destination information may be used to direct the finished product to a special shipping area or distribution site allowing for further automation of the packaging system 20. All of the carton may be placed within a single magazine 26 or have separate magazines on a multiple magazine apparatus disclosed in co-pending U.S. patent application Ser. No. 09/063,908 filed on Apr. 21, 1998, for a Multiple Magazine For A packaging Machine, which is hereby incorporated by reference in its entirety. For example, the magazine 26 may hold blanks for two percent milk packaged in an one liter carton 90. The magazine 26 may also hold blanks for whole milk packaged in a one liter carton 91. Further, the magazine 26 may hold blanks for cream packaged in a five-hundred milliliter carton 92. Yet further, the magazine 26 may hold blanks for skim milk packaged in a five-hundred milliliter carton 93. During processing of the blanks 30 from the magazine 26 to the filling station 40, the bar code reader 50 reads the bar code 51 of each of the carton 90–93 and conveys this information to the packaging machine 22 via the PLC 21. The PLC then instructs the various components of the machine 22 in order to produce a product as indicated by the bar code 51. The operational flow of the bar code 51 information is described in FIG. 5.

As shown in FIG. 1A, the bar code reader 50 may be placed at the intersection of the magazine 26 and the carton opener 24. As each blank 30 is prepared for erection on the carton opener 24, the bar code reader 50 reads the bar code 51 and transmits the information to the PLC 21. The PLC 21 may be a component of an overall control system for the packaging system 20. A preferred control system is disclosed in U.S. Pat. No. 5,706,627 for a Control System For A Packaging Machine which is hereby incorporated by reference in its entirety, and which has the same assignee as the present application. A preferred bar code reader 50 is a laser bar code reader. A preferred laser bar code reader is the BL-500 laser bar code reader available from Keyence Corporation of America, Woodcliff Lake, N.J.

There is illustrated in FIG. 5 a dual stream filling system of co-pending U.S. patent application Ser. No. 08/897,554 filed on Jul. 21, 1997 and an entitled Dual Stream Filling Valve, which is hereby incorporated by reference in its entirety. The filling system 40 has a primary tank 118 and secondary tanks 120 in flow communication with nozzles 144. Pumps 122 and 124 control the flow of the product into cartons, not shown, which are positioned under the nozzles 144. Each primary fill pipe 116 has a secondary fill pipe 110 concentrically enclosed therein. Pump mechanisms 124 control the flow of the secondary product from the secondary tanks 120 to the secondary fill pipes 110. The pump mechanisms 122 control the flow of the primary product from the primary tank 118 to primary fill pipes 116. Each of the pump mechanisms 122 and 124 are controlled by a servomotor 125 which are controlled by servo amplifiers 131, not shown. In operation, the secondary product may be cream and the primary product skim milk. The PLC 21, with instructions from a bar code reader 50, instructs the filling system 40 to fill a predetermined quantity of cartons with a specific product. For example, if the product is two percent milk, the fillings system 112 dispenses a set quantity of skim milk from the primary product tank 118 and a set quantity of cream from secondary tanks 120 directly into a carton for mixing. This filling system 40 allows for the continuous product of different products without the need to deactivate the packaging machine 22 to produce a different product. A similar filling system is disclosed in U.S. Pat. No. 5,687,779 which is hereby incorporated by reference in its entirety.

As shown in FIGS. 6 and 7, an alternative filling system 40*a* having multiple filling stations 202–207. Each filling station 202–207 dispenses an unique product. For instance station 202 may dispense yogurt, station 203 may dispense jam, station 204 may dispense water, station 205 may dispense juice, station 206 may dispense skimmilk, and station 207 may dispense cream. Each station 202–207 has a pump 124*a,* a servomotor 125 to control the pump 124*a,* and a fill pipe 220. As cartons are conveyed into the filling system 40*a,* the PLC directs the positioning of the cartons 92, 93, 211–214 under a specific filling station 202–207 according to information from the bar code reader 50 which transmitted such information to the PLC 21.

As shown in FIG. 8, yet another alternative filling system 40*b* is disclosed. In this system, the fill pipes 320*a* and *b* are positioned adjacent to each other instead of concentrically disposed within one another. Pumps 324*a* and *b* control the flow of product to the fill pipes 320*a* and *b* form product sources 330*a* and *b*. The pumps are in turn controlled by servomotors.

As shown in FIG. 9, the instructional communication flow from the bar code reader 50 to the filling systems 40, 40*a* and 40*b* is set forth. At step 400, the bar code reader 50 reads the bar code on a blank 30 or partially formed carton. At step 402, this information is transmitted to the PLC 21. At step 404, the information is transmitted from the PLC 21 to a programmable axis manager. The programmable axis manager ("PAM") controls the plurality of servo amplifiers that control the plurality of servomotors on the packaging machine 22. At step 406, the PAM directs servo amplifiers which controls servomotors 125 for a filling system 40, 40*a,* 40*b*. At step 408, servomotors 125 actuate a pump 122, 124, 124*a* or 324*a* and *b* to dispense a specific product into a carton when a specific carton arrives at the filling system 40, 40*a* and 40*b*. The PLC 21 is able to control the filling of a carton that has traveled some distance on the packaging machine 22 away from the bar code reader 50 due to the controlled/indexed movement of cartons on the packaging machine 22. In this manner, the PLC 21 is aware of the position of each carton that has had its bar code 51 read by the bar code reader 50. At step 410, the pump pumps product into a carton according to instructions obtained from the bar code 51 of the carton.

The PLC 21 may also control adjustments to the packaging machine 22 to produce a certain product. For instance, if the volume changes from one liter to five-hundred milliliters, then a lifter on the machine 22 must be adjusted to account for the difference in package height. Also, the PLC would control the top sealing and even the bottom forming to adjust for changes in the size of the cartons. In one embodiment, as different size cartons are prepared to enter the machine 22, the PLC suspends movement, and thus introduction of cartons, while the machine 22 adjusts to the new carton size.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

What is claimed is:

1. A method for automatically, consecutively forming, filling and sealing different carton blanks for different products in a single form, fill and seal packaging machine, the form, fill and seal packaging machine having a magazine for storing and supplying different carton blanks and having a filling system, the method comprising:

providing a magazine for storing and supplying different types of carton blanks;

retrieving a first carton blank from a plurality of blanks;

reading a bar code on the first carton blank through use of a bar code reader;

erecting the first carton blank into a partially formed carton;

conveying the carton along a conveyor of the packaging machine; and filling the carton with a product according to information obtained from the bar code of the carton blank, the filling occurring at a filling station of the packaging machine.

2. The method according to claim 1 further comprising transmitting information from the bar code to a PLC.

3. The method according to claim 1 wherein the bar code reader is positioned on the magazine.

4. The method according to claim 1 wherein the bar code reader is positioned along a conveyance line of the packaging machine.

5. The method according to claim 1 wherein the magazine is a multiple magazine having a plurality of magazines for each unique set of cartons.

* * * * *